US006163080A

United States Patent [19]

Castellon

[11] Patent Number: 6,163,080

[45] Date of Patent: Dec. 19, 2000

[54] ANTI-PINCHING SYSTEM BASED ON MODIFICATION OF THE LIGHT CONDUCTIVITY OF AN OPTICAL FIBRE FOR AUTOMATIC CAR WINDOWS

[76] Inventor: Melchor Daumal Castellon, Diputacion, 455-457, 08013 Barcelona, Spain

[21] Appl. No.: 09/253,166

[22] Filed: Feb. 19, 1999

[30] Foreign Application Priority Data

Feb. 25, 1998 [ES] Spain ..... 9800393
Aug. 10, 1998 [ES] Spain ..... 9801717

[51] Int. Cl.[7] ..... E05F 15/20

[52] U.S. Cl. ..... 307/10.1; 49/27; 49/28; 200/61.43; 318/256; 318/280; 250/227.31

[58] Field of Search ..... 307/10.1; 49/27, 49/28; 200/61.43, 61.42; 250/227.31; 318/266, 265, 469, 280, 283

[56] References Cited

U.S. PATENT DOCUMENTS 4,944,116 7/1990 Mewald ..... 49/27
5,945,796 8/1999 Ohmori et al. ..... 318/266
5,955,854 9/1999 Zhang et al. ..... 49/28
5,983,567 11/1999 Mitsuda ..... 49/26
5,994,858 11/1999 Miura ..... 318/283

*Primary Examiner*—Albert W. Paladini

[57] ABSTRACT

A system which takes direct action to reverse the rotation of the window driving motor includes an optical fiber conductor arranged inside a substantially prismatic profile forming loops at the points where said conductor enters and exits from a series of incisions formed at regular intervals in the lateral areas of said profile. The profile is fitted inside a covering in the frame of a door. The incisions comprise a mouth for insertion of the conductor through a passageway which ends in the cavity wherein the conductor is retained by an adhesive or the like. The optical fiber conductor may be arranged continuously over the entire length of the perimeter of the frame or over parts thereof.

8 Claims, 2 Drawing Sheets

ANTI-PINCHING SYSTEM BASED ON MODIFICATION OF THE LIGHT CONDUCTIVITY OF AN OPTICAL FIBRE FOR AUTOMATIC CAR WINDOWS

BACKGROUND OF THE INVENTION

The present application for a Patent of Invention relates, as indicated in its title, to "AN IMPROVED ANTI-PINCHING SYSTEM BASED ON MODIFICATION OF THE LIGHT CONDUCTIVITY OF AN OPTICAL FIBRE FOR AUTOMATIC CAR WINDOWS", whose new characteristics of construction, form and design fulfil with maximum reliability and efficacy the purpose for which it has specifically been designed.

The invention relates more specifically to the design of a new anti-pinching system using a light transmission means to detect obstacles between the perimeter of the car window and the frame of the door and of said window.

A plurality of systems exist on the market, and may therefore be regarded as prior art, which are capable of detecting an obstacle when a car window ascends in its frame in response to pressure exerted by the user on the window control button.

Said systems which may regarded as prior art may be divided into two broad groups, direct systems and indirect systems. The first thereof consist of sensors which, owing to their sensitivity, permit direct detection of the obstacle and send the appropriate signal to the electric motor whose role it is to actuate the various components involved in raising the window in such a way that the latter is stopped and its operation is reversed, such that it descends.

The indirect systems act in the normal manner on the motor and analyse the operation thereof in such a way that, when the window encounters an obstacle, a variation is produced in the current circulating through the electric motor or a modification is produced in the speed of rotation thereof, which is detected by the appropriate sensors incorporated in the electric motor. That is to say, it is through this variation in current or speed that the system detects the presence of an obstacle between the window and its frame, causing the motor to stop and reverse its direction of rotation.

Although the above systems represent considerable progress with respect to early arrangements which did not provide said anti-pinching and obstacle-detection systems, they exhibit severe limitations since they are subject to frequent breakdowns and in some cases they interpret modifications in the environment in which the window is displaced as obstacles, for example hardening of the guideways or the rubber seals disposed in the door frame in many cases causes an increase in the resistance encountered by the window as it ascends in the frame, which the sensors interpret as the unexpected presence of obstacles, such that they stop the motor and reverse its rotation, obliging the user to return to the dealer so that the problem can be solved by reprogramming of the various systems so as to prevent said disadvantages.

On another technical plane, the above-described systems are in many cases incapable of sensing pinching at the sides, that is to say not only pinching which occurs between the upper part or edge of the window and the frame but also pinching which occurs between the side edges of the window and the side frames thereof, which is something which may happen with the rear windows in many car models and may cause serious injury to persons but cannot be detected by the above-described systems owing to the limitations thereof. This situation has been amply described in publications and journals relating to the industry.

The gravity of the above-described situations has caused even the authorities of the European Union to publish appropriate standards to ensure that the force with which the automatic windows are raised does not exceed critical values since, if this is not the case, such windows may cause very serious injuries to fingers, arms, the neck and other parts of the body which may become trapped between the upper or side edges of the window and those of the door frames or structures covering the latter.

DESCRIPTION OF THE INVENTION

The subject matter of the proposed invention is the design of an anti-pinching system for automatic car windows, which is intended to be capable of overcoming the above disadvantages in that it is capable of detecting obstacles directly by means of a light sensor disposed along the entire length of the window frame, the operation of which light sensor is based on the arrangement of an optical fibre conductor around the entire perimeter of said frame.

Said optical fibre conductor acts as a sensor and may be integrated into a special covering or directly into the covering of the frame, it being possible in some cases even to reduce the cost of the construction of said covering by incorporating that belonging to the insulating means with that belonging to the sensor means.

Tests carried out using this new anti-pinching system demonstrate that when the window to be raised in the door frame by suitable means encounters an obstacle, pressure is exerted on the covering and the proposed sensor in such a way that the latter reduces the amount of light it transmits, this reduction being analysed by the appropriate electronic systems provided with sufficient memory for comparing a normal light transmission value with a modified value, this comparison being used to interpret that said variation is caused by an obstacle encountered during raising of said window and the electric motor which actuates raising of said window then being commanded to stop, after which rotation of said motor is reversed, resulting in lowering of the window.

The proposed system combines great simplicity with low cost, by using commercially available components which do not therefore have to be newly designed, and with great ease of manufacture, since it may either be integrated into a special covering or, if necessary, be integrated into any of the surfaces of the covering of the door frame or the structure thereof.

The field and laboratory trials carried out with said system have demonstrated that higher sensitivity values may be obtained for the optical fibre conductor, that is to say a greater improvement of the system with respect to obstacles, by arranging the optical fibre conductor in loops, for which it is necessary to redesign the system in such a way that it includes both a rubber profile, which permits arrangement of said optical fibre in loops, and a new system of sensors which make it possible for the reference value not to have to be stored prior to operation of the system.

The proposed rubber profile, which is located inside the window frame and which is installed inside the seal located in the window frame, is designed in such a way that it comprises a series of incisions which permit arrangement of the optical fibre in undulating form, in such a way that, in said arrangement, said optical fibre protrudes therefrom, and in this way the angle of refraction in the case of deformation increases in magnitude and therefore increases the sensitivity of the system when the latter detects an obstacle, the upper edge of the window deforming said loops.

The incisions formed in the profile for passage of the optical fibre conductor and the arrangement thereof in looped form make it possible that, once positioning has been effected inside by suitable means, they are covered with adhesives or welded to keep covered the areas protected by the sealing profile, in such a way that all this permits wholly automated production.

The above-described profile is included inside the general seal which covers the whole window frame and which is situated at the upper part of the door.

In addition to the different arrangement of the optical fibre described above, another aim of the present invention is to modify the system for detecting obstacles so that it changes the reference value, that is to say the 30 millisecond value relating to the absence of obstacles, prior to raising the window, that is to say at the same moment in which the user presses the button to close the open window the improved system emits a signal for detecting the optical fibre transmission value at that moment, without any type of obstacle being present and before the window even starts its upward movement.

When the window, upon ascent, encounters an obstacle, the latter is pressed by the upward force thereof against the profile and the frame seal, which, in the system proposed in the main patent, changes the light conductivity value, and the sensor detects from said modification and reduction in transmission that an obstacle is present and causes the motor to stop and reverse its direction of rotation in such a way that the window descends and releases the obstacle from the upper edge of the window and the window frame.

By providing an instantaneous value which is not previously stored, the modification in the system for detecting the reference value thus allows the improved anti-pinching system to which the present invention relates to be independent of the variations in voltage which may occur in the car, that is to say when, for whatever reason, the car finds itself without power, whether because an electric circuit has been cut or because the battery is flat or for any other reason, it is not necessary, as happens with anti-pinching systems constituting the prior art, to reprogram the anti-pinching system and re-store the reference values so that the system may operate.

Therefore, given that in the systems which constitute the prior art said reference value differs depending on the model of car since different models exhibit differences with respect to the motor, the window length, the weight, the length of the seals and amount of friction, said improved anti-pinching system may be used in all types of cars and doors, whatever their structure, configuration and length, the weight of the windows and any other variant which a change of car model entails.

The incisions formed in the profile for passage of the optical fibre conductor and the arrangement thereof in looped form allow that, once said conductor is positioned therein by suitable means, the incisions are covered with adhesives or welded to keep covered the areas protected by the profile, in such a way that all this permits wholly automated production.

The above-described system with the improvements proposed in the present invention will be used to prevent pinching in doors, the bonnet and the boot, as well as in sunroofs.

Other details and characteristics of the invention will become clear from a reading of the description given below, which refers to the drawings accompanying this specification and in which the details referred to are shown schematically. These details are given by way of example, referring to one possible practical embodiment which is not limited to those details described here; therefore, this description should be regarded as an illustration, not limiting in any way.

BRIEF DESCRIPTION OF THE DRAWINGS

There follows a detailed list of the various elements cited in the present invention, (10) door, (11) inner side, (12) frame, (13) frame covering, (14) sensor, (15) sensor covering, (16) electric motor, (19) relay, (20) meter, (21) window, (22) cable, (23) guideway, (24) support, (25) sensor, (26) profile, (27) incisions, (28) mouth, (29) passageway, (30) cavity, (31) optical fibre, (32) end, (33) end, (34) loops.

DESCRIPTION OF THE DRAWINGS

Figure 1:
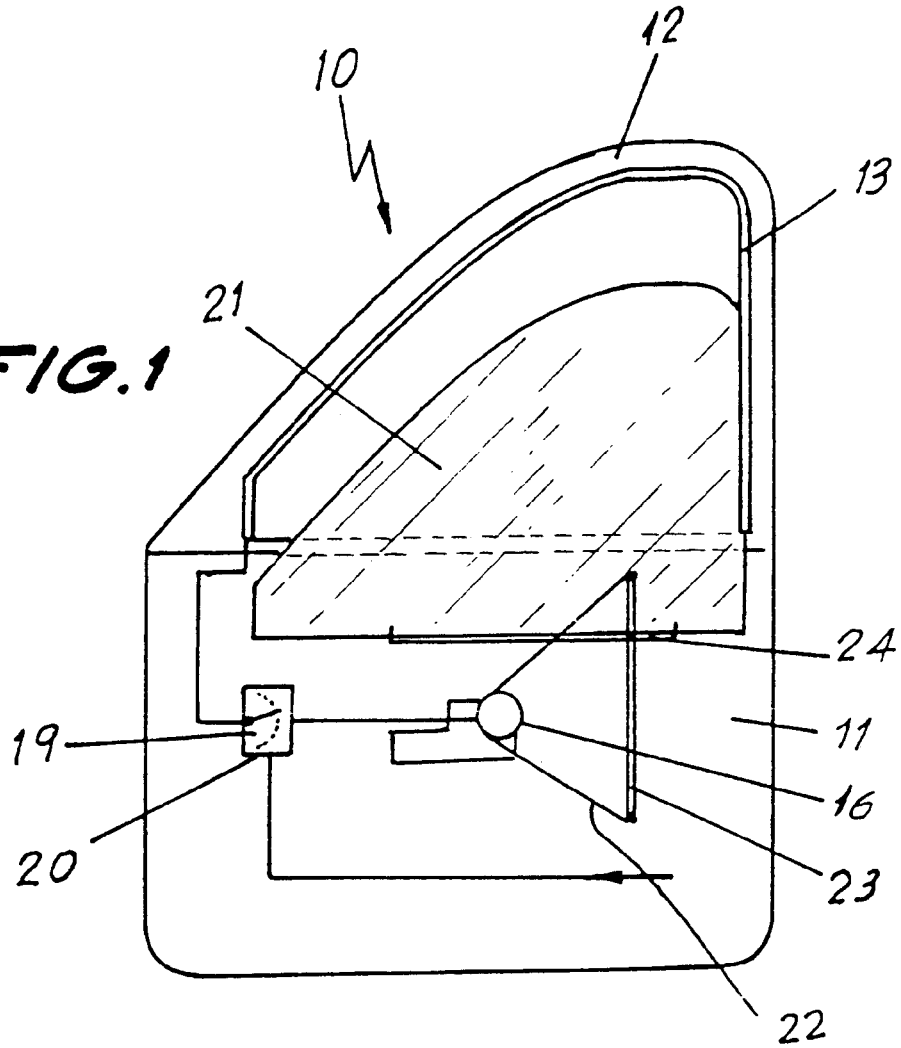
FIG. 1 is a schematic front elevational view of a car door (10) viewed from the inside, in which the conventional components are arranged which permit raising and lowering of a window (21).
Figure 2:
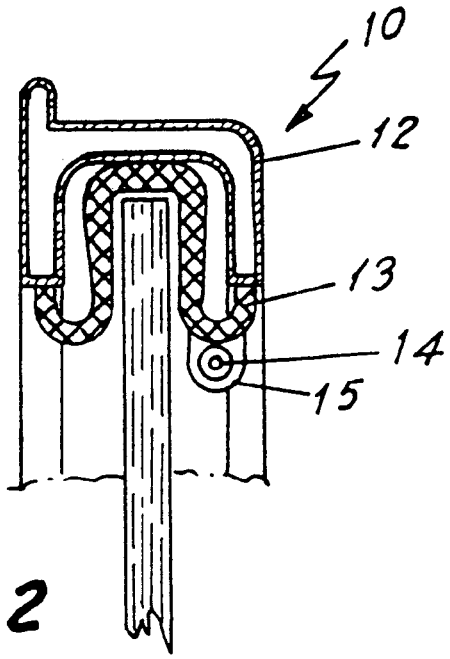
FIG. 2 is a partially cross-sectional elevational view of a frame (12) of a door (10), in which is located the proposed system.
Figure 3:
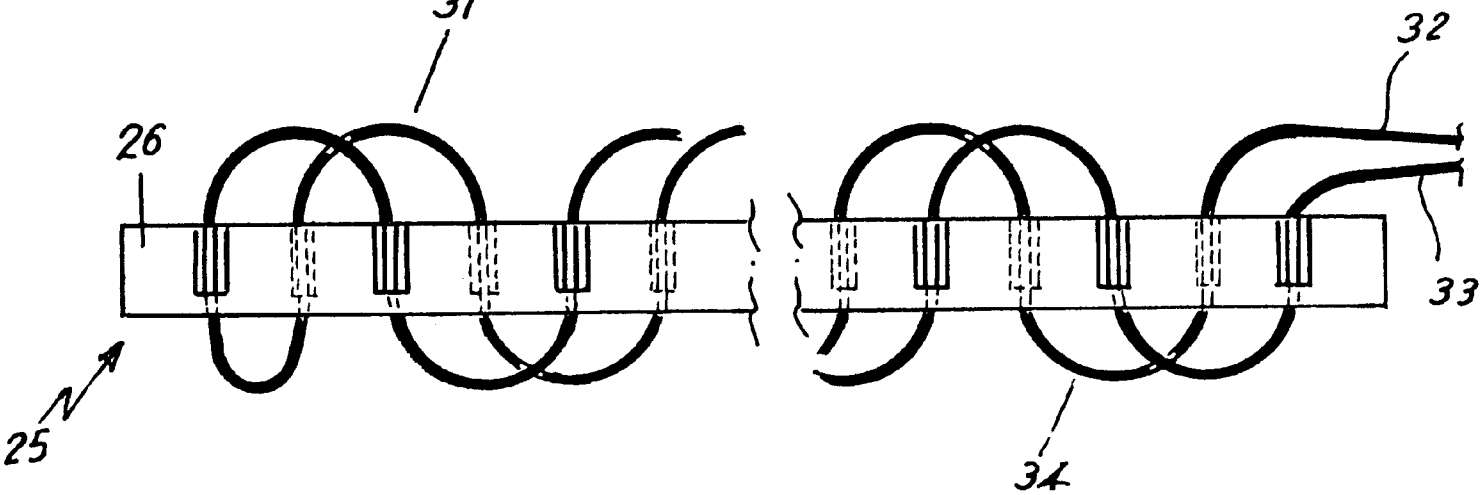
FIG. 3 is a front elevational view of the sensor (25) formed by the profile (26) and the optical fibre conductor (31), forming a series of loops (34).

In one of the embodiments which may be regarded as prior art and which may be seen in FIG. 1, a door (10) takes the form of a sheet which has been duly machined into shape and is provided at its upper part with an appropriate frame (12) which, as may be seen in FIG. 2, is covered on the inside with a covering (13) which may become attached to a conventional window when the latter is raised, in such a way that when pressure is exerted on the upper part of said covering (13) a perfect seal is produced between the outer part and the inner part of the car.

FIG. 1 also shows the various components which are conventionally used for raising said window (21), such as an electric motor (16) which is supplied with power by a power source, not shown in the Figures, via a cable (22) and a guideway or guideways (23) which allow(s) vertical displacement of a support (24) located at the lower part of the window (21) and which, by means of the above-described components together with others of electrical nature, such as a relay (19) and a meter (20), form a system for detecting and reversing the movement of said window (21) in the frame (12) of the door (10).

FIG. 2 shows (13) the covering of the frame (12)–(13) in turn incorporates another covering (15), which has the sensor (14) incorporated within it.

The sensor (14) takes the form of an optical fibre conductor (31), which extends over the whole length of the frame (12) or part thereof.

Operation of the system is as follows: when the window is raised and lowered by means of the above-described components without any problems, there passes through the inside of the conductor (31) a quantity of light determined in accordance with the characteristics of the system and the particular characteristics of the optical fibre conductor, which is detected continuously by an electronic system not shown in the Figures.

When the window encounters any type of obstacle at its upper or side edges and said obstacle is pressed by the vertical ascending action of the window (21) against the covering (13) of the frame (12), the covering (15) of the sensor (14) receives pressure which is transmitted in turn to said conductor (31), consequently restricting and reducing the conduction and quantity of light, which is determined and detected by suitable electronic means programmed to carry out periodic checks such that any variation in the conduction of light will be interpreted to denote the presence of an obstacle.

By means of these suitable programming means, any variation in the conduction of light in the conductor (31) may be interpreted as a modification in the environmental conditions, that is to say any damage to the covering (13) or (15) caused by external means, aging or by poorly effected repairs to the door (10) of the car.

Embodiments may be considered equivalent which introduce the presence of an optical fibre conductor (31) not over the entirety of the length of the frame (12) but only over part thereof, better to suit the configuration and characteristics of said frame and car door (10).

An embodiment of the proposed system is one in which the covering of the door frame in turn incorporates another covering, the appropriate sensor being arranged therein, which sensor takes the form of an optical fibre conductor in wholly lengthwise arrangement, the length of said conductor covering all or part of the length of the window frame.

Said arrangement has been improved by the subject matter of the present, in such a way that said covering has been modified so that it may include a substantially prismatic profile (26), which exhibits regularly spaced incisions (27).

Figure 4:
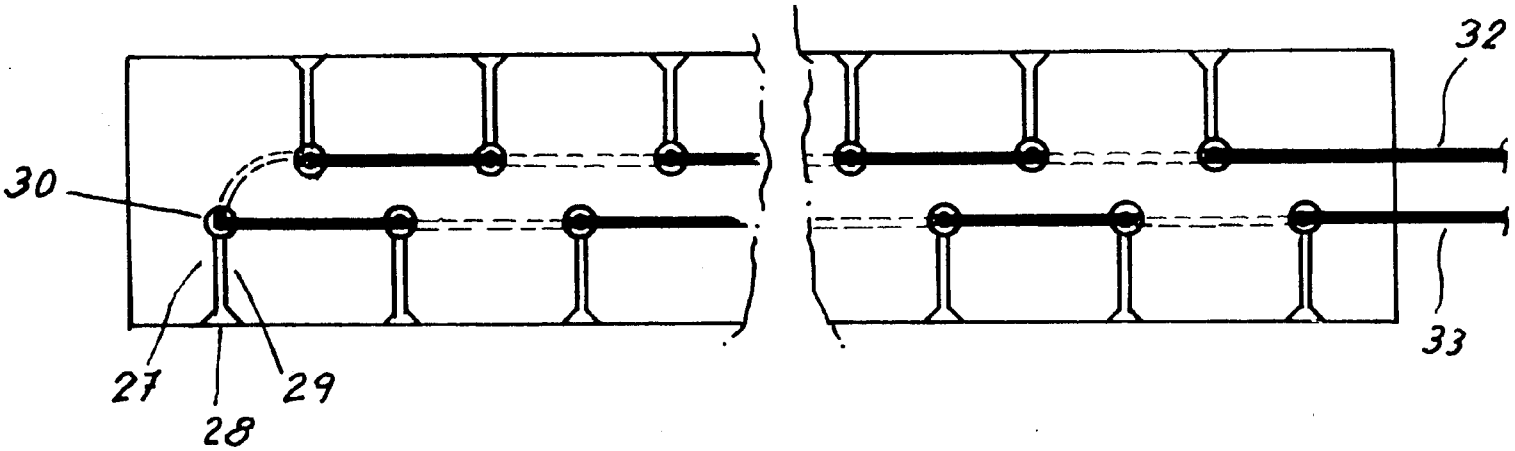
FIG. 4 is an upper plan view of the profile (26) with the proposed arrangement.

As may be seen in FIG. 4, each incision (27) comprises a mouth (28) which allows the optical fibre conductor (31) to be pressed into position by any known means so that it may slide through the passageway (29) until it (31) is situated in the cavity (30), in such a way that loops (34) are formed, as may be seen in FIG. 4, forming a complete circuit, in such a way that the ends of the conductor (31), (32 and (33), may be connected by suitable means to the unit which the system includes for measuring light conductivity.

Once the optical fibre (31) is positioned inside the cavity (30), via the mouth (28) of the passageway (29), any known system is used to position an adhesive or to effect subsequent welding, in such a way that said optical fibre conductor (31), in the form shown in FIG. 1, cannot be displaced.

An additional aim of the present invention is that the anti-pinching system should dispense with a reference value stored permanently prior to actuation of the system, that is to say that the anti-pinching system operates between a reference value, which will be that measured in the instant prior to raising the window, not shown in the Figure, and the modified value obtained when said value is modified by the imprisonment of an object between the upper edge of the window and the window frame.

The arrangement of the optical fibre conductor (31) in loops (34) inside the profile (26), see FIG. 4, allows easier detection of any pressure thereon which may result from trapping an object between the upper edge of the door frame and the upper edge of the window than when the optical fibre conductor (31) of the main patent is disposed along the frame.

Once the optical fibre conductor (31) has been positioned inside the profile (26), the latter and the incisions (27) are covered with adhesive or welded, so as to be subsequently introduced by suitable means into the internal covering of the frame.

The subject matter of the present Patent has been adequately described, in relation to the attached drawings, and it will be understood that any modifications in detail may be made to the same which are considered advantageous as long as the proposed variations do not alter the essence of the invention.

What is claimed is:

1. An improved anti-pinching system arrangement based on modification of the light conductivity of an optical fibre comprising a window frame, a window moveable between first and second positions within said window frame, a reversible motor coupled to said window for moving said window between said first and second positions, an optical sensor disposed in a support having a prismatic profile and comprising a flexible optical fibre loop which conducts light along its length and is subject to modulation in response to a change in the flexure of said loop, said optical sensor connected to said frame and located in a position such that an object in said frame will be pressed by said window against said loop when said window is moved toward one of said first and second positions, and an electronic system coupled to said optical sensor and reversible motor and adapted to the sense said modulation of light and send a control signal to said reversible motor.

2. An anti-pinching arrangement according to claim 1 in which the flexible optical fibre has an undulating path extended along the length of said support and having a plurality of loop sections protecting from a surface of said support.

3. An anti-pinching system arrangement according to claim 2 in which said support has a plurality of laterally spaced incisions on one side of said support for defining a plurality of loops between adjacent pairs of said incisions on said one side.

4. An anti-pinching arrangement according to claim 3 in which each of said incisions has an enlarged taper at their entrance at said side.

5. An anti-pinching system arrangement according to claim 2 in which said support has a plurality of laterally spaced incisions on first and second opposing sides of said support for defining a plurality of loops between adjacent pairs of said incisions on each of said first and second sides.

6. An anti-pinching arrangement according to claim 5 in which each of said incisions has an enlarged taper at their entrance at said side.

7. An anti-pinching system arrangement according to claim 6 in which said optical sensor support is disposed continuously over the entire length of the perimeter of said window frame.

8. An anti-pinching system arrangement according to claim 3 in which said optical sensor support is disposed continuously over the entire length of the perimeter of said window frame.

* * * * *